US005482333A

United States Patent [19]

Gehrs et al.

[11] Patent Number: 5,482,333

[45] Date of Patent: Jan. 9, 1996

[54] ONE-PIECE POLYMERIC DOOR LATCH WITH AN INTEGRAL SPRING

[75] Inventors: Donald F. Gehrs, Brandon; Louis L. Runge; Percy A. White, both of Clinton, all of Miss.

[73] Assignee: Eaton Corporation, Cleveland, Ohio

[21] Appl. No.: 153,059

[22] Filed: Nov. 15, 1993

[51] Int. Cl.[6] ..... E05C 1/10

[52] U.S. Cl. ..... 292/163; 292/DIG. 61; 292/DIG. 63

[58] Field of Search ..... 292/DIG. 38, 175, 292/163, DIG. 61, DIG. 63, DIG. 65, DIG. 76

[56] References Cited

U.S. PATENT DOCUMENTS

| | | | |
|---|---|---|---|
| 3,240,039 | 11/1962 | Baermann | 292/175 |
| 3,751,087 | 8/1973 | Hawkins | 292/175 |
| 3,841,674 | 10/1974 | Bisbing | 292/175 |
| 3,850,464 | 11/1974 | Bisbing | 292/175 |
| 4,320,834 | 3/1982 | Tamaki | 292/175 |
| 5,072,071 | 12/1991 | Cassity et al. | 174/65 |
| 5,121,952 | 6/1992 | Jason | 292/DIG. 38 |
| 5,134,543 | 7/1992 | Sharp et al. | 361/358 |

OTHER PUBLICATIONS

Westinghouse Electric Corporation, Catalog 30–390, pp. 1 through 8 dated May 1990.

*Primary Examiner*—Steven N. Meyers

*Assistant Examiner*—Gary Estremsky

*Attorney, Agent, or Firm*—Martin J. Moran

[57] ABSTRACT

A sliding, door latch has a latch member and a spring member integrally molded in one-piece. The latch member, which can be secured in a latch opening in a thin door panel without the use of tools, includes a planar base member which covers and slides reciprocally in the opening. An integral actuator extends traversely from the back of the base member through the opening and has integral bosses on its sides which form grooves engaging tangs in the sides of the latch opening. An integrally molded latch finger projects from the actuator toward the door panel edge. The spring member includes a first pair of spaced apart elongated elements integrally hinged to the actuator, a second pair of elongated elements integrally hinged at one end to the first pair, a beam integrally hinged to and connecting the other ends of the second pair of elongated elements, and a hook integrally molded to the center of the beam and engaging the rear edge of latch opening. The integral spring member biases the latch to the latched position. A finger pocket recessed in the actuator is engaged to slide the latch away from the latched position thereby bending the hinges of the spring member. When the finger pocket is released, the hinges open returning the latch to the latched position.

4 Claims, 2 Drawing Sheets

ONE-PIECE POLYMERIC DOOR LATCH WITH AN INTEGRAL SPRING

BACKGROUND OF THE INVENTION

1. Field of the Invention

This invention relates to a door latch adapted for mounting in an opening in a door panel, especially metal door panels of cabinets housing electrical equipment, such as for example, load centers. More particularly, it is directed to a one-piece polymeric door latch having an integral spring which engages the edge of the opening in the door panel and biases the latch to the latched position.

2. Background Information

Various enclosures with doors commonly employ a sliding latch to retain the door in the closed/latched position. Typically, the door latch utilizes mechanical fasteners for securement to the door, and a metal spring to automatically return it to the latched position. Mechanical fasteners and springs are costly to procure, store and assemble. Expensive insertion equipment is also required to install such fasteners.

A simple, effective, existing door latch for metal cabinets, such as electrical load centers, has a polymeric base member which covers and slides relative to a latch opening in the metal door panel. An actuator molded integrally with the base member extends through the opening and has projections on each side which engage the underside of the door panel. A molded latch hook projects from the actuator toward the door jam. The latch is biased toward the door jam by a separate, stamped metal spring which clips onto the edge of the opening in the door panel and bears against the actuator. The actuator has a finger pocket which is engaged to slide the latch member toward the unlatched position. The metal spring automatically returns the latch to the latch position when released. Other types of separate metal springs such as coil or wire springs are used in similar types of door latches. As mentioned, metal springs are costly. They are also subject to hydrogen embrittlement resulting from the plating process. It is not unknown for such springs to break during storage before the latch is even put into use.

Another existing load center has a polymeric door with integrally molded ribs which provide a spring force biasing a polymeric sliding latch toward the latched position.

There is a need for a door latch having a spring which is not subject to embrittlement.

There is also a need for a door latch which does not require a separate metal spring and the tools required to install such a door latch.

There is a further need for an improved door latch which is easy and inexpensive to manufacture.

There is still another need for an improved door latch with all the above characteristics which can be used with a thin door panel, such as a metal door panel.

SUMMARY OF THE INVENTION

These and other needs are satisfied by the invention which is directed to a polymeric door latch having an integral biasing spring which can be molded in one-piece. This one-piece polymeric latch includes a body member which covers and slides within an opening in a door panel. The integral spring engages an edge of the opening to apply a force which biases the latch toward the latched position.

More particularly, the door latch of the invention includes a latch member comprising a base member covering the opening from a front side and slidable reciprocally within the opening, an actuator integral with and extending generally transversely from the base member through the opening in the door panel and a latch finger integral with and projecting from the actuator toward a first end of the opening. The door latch of the invention further includes a spring member integral with and extending from the latch member and engaging the door panel to bias the latch member toward a latched position at a first end of the opening in the door panel. Preferably, the spring member comprises a first elongated member comprising a pair of parallel, spaced elongated elements integrally hinged to the actuator at first ends and a second elongated member comprising a second pair of parallel, spaced elongated elements integrally hinged to second ends of the first pair of elongated elements and integrally hinged at second ends to a transverse beam of a terminal member which also has a hook member with a slot which engages the edge of the opening in the door panel.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
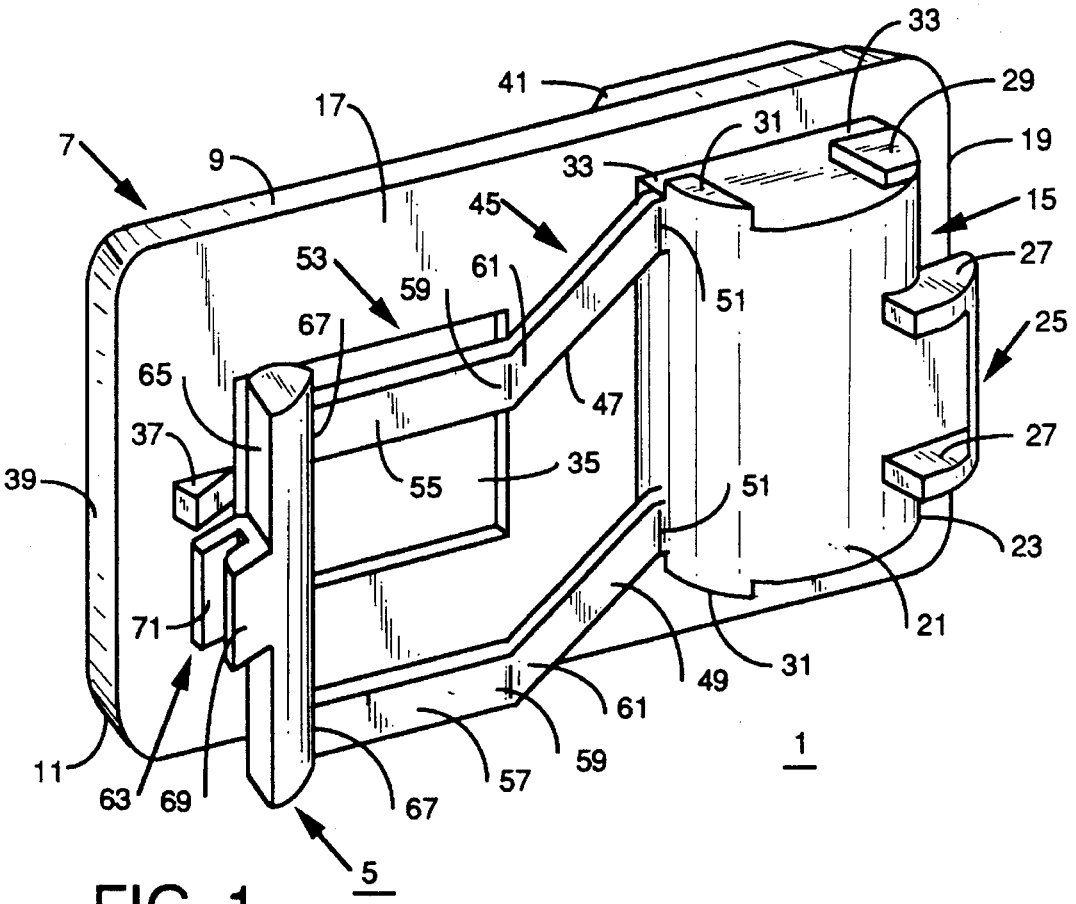
FIG. 1 is an isometric view of a door latch in accordance with the invention.

Referring to the figures, the latch 1 of the invention has a latch member 3 and a spring member 5 integrally molded as one piece. The latch member 3 has a rectangular, planar base 7 having a beveled peripheral edge 9 radiused at 11 into a front-face 13. An actuator 15 integrally molded with the base 7 extends generally transversely from the rear face 17 of the base 7 adjacent one end 19. The protruding end 21 of the actuator 15 is rounded at the comers 23.

A latch finger 25 is integrally molded with the actuator 15 to project generally parallel to the rear face 17 of the base member in the direction of the end 19 of the base. This latch finger 25 is reinforced by integral ribs 27. A pair of bosses 29 and 31 molded into each side of the actuator 15 and spaced from the rear face 17 of the base 7 form grooves 33, which as will be seen secure the latch 1 to a door panel.

Figure 3:
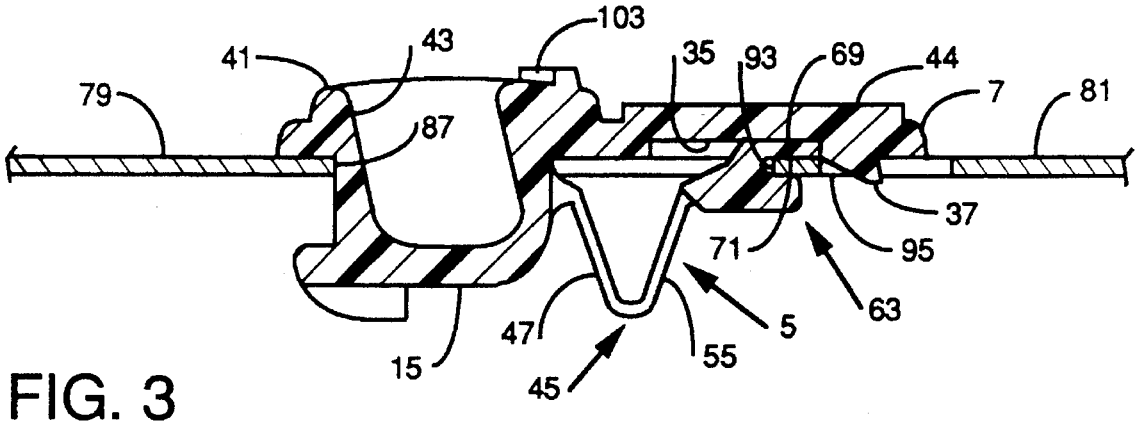
FIG. 3 is a cross-sectional view through the latch of FIG. 1 installed in the door panel of FIG. 2 and shown biased to the latched position.
Figure 4:
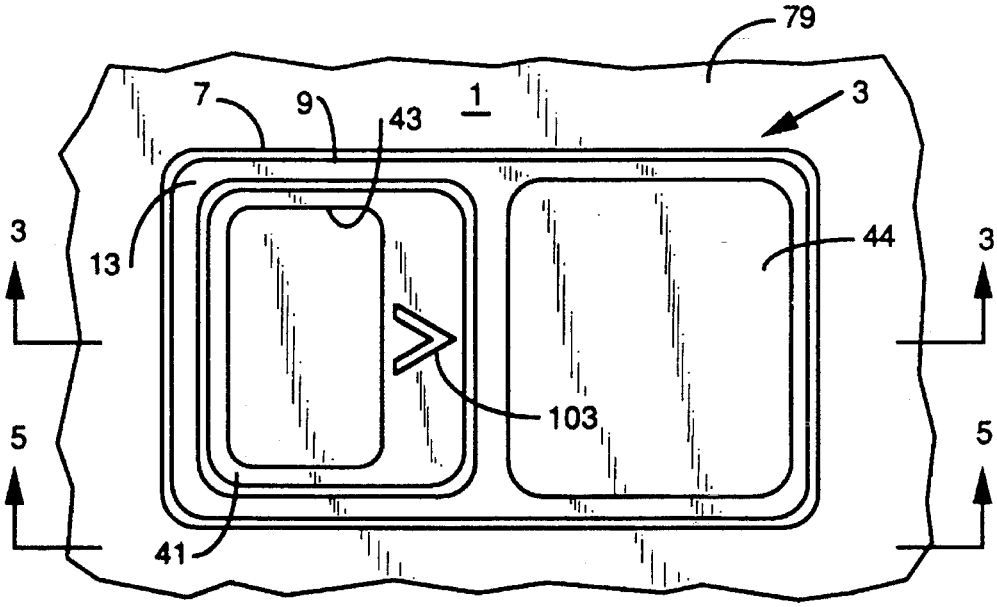
FIG. 4 is a front elevation view of the door latch in FIG. 1.
Figure 5:
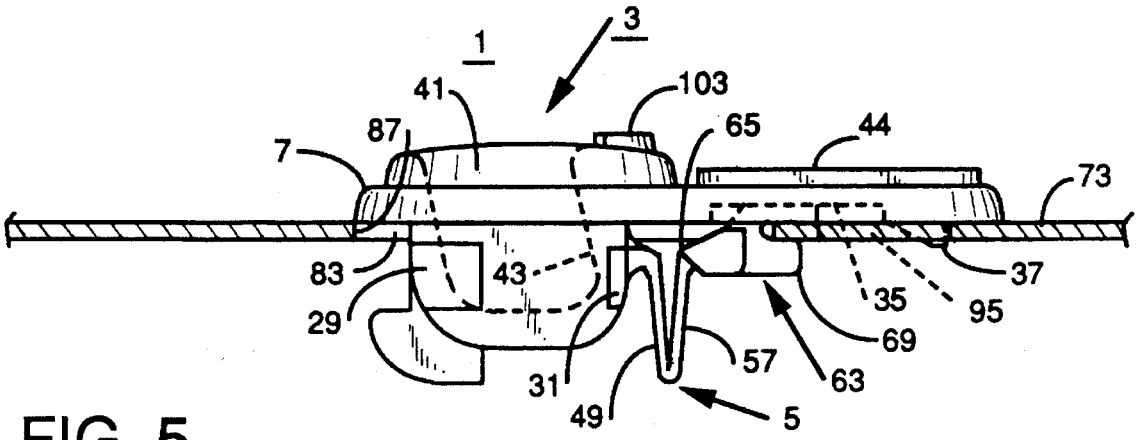
FIG. 5 is a side elevation view of the latch shown in the unlatched position.

The rear face 17 of the base 7 of the latch member 3 has a recess 35, the purpose of which will become clear. A wedge shaped stop 37 is integrally molded into the rear face 17 adjacent a second end edge 39. As best seen in FIGS. 3–5, a raised platform 41 extends outward from the front face 13 of the base 7 generally in alignment with the actuator 15. A recess 43 extends through the raised platform 41 into the actuator 15 to form a finger hold for operation of the latch 1 as will be seen later. As shown in the cross-section of FIG. 3, this recess 43 is inclined slightly away from the latch finger 25 for a more comfortable finger hold. A second raised area 44 on the front face 13 adjacent to, but not protruding as far as the raised platform 41, can be used to display an integrally molded trademark for the latch, or other indicia.

The spring member 5 includes a first elongated member 45, which itself includes a pair of spaced, parallel, elongated elements 47 and 49 which are integrally hinged at one end 51 to the actuator 15. The spring member 5 also includes a second elongated member 53, also having a pair of spaced apart, parallel, elongated elements 55 and 57. First ends 59 of the elongated elements 55 and 57 are integrally hinged to second end 61 of the elements 47 and 49.

The spring member 5 also has a terminal member 63 including a beam 65 which is integrally hinged at either end to the second ends 67 of the elongated elements 55 and 57. A hook 69 with a slot 71 is integrally molded to the center of the beam 65.

Figure 2:
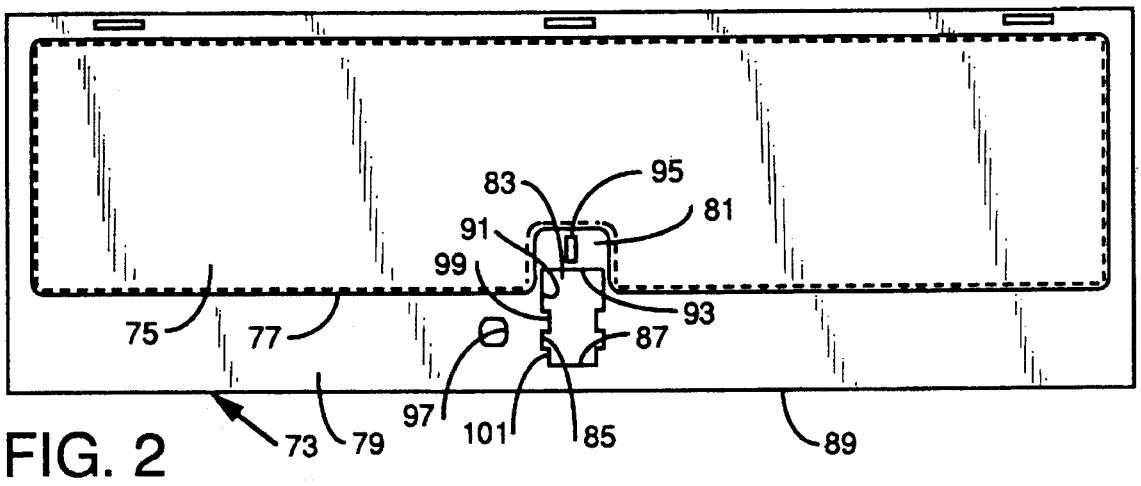
FIG. 2 is a fragmentary plan view of a door panel having openings in which the latch of FIG. 1 is installed.

FIG. 2 is a plan view, in reduced scale, of a section of a metal door panel 73 in which the latch 1 is to be installed. The door panel 73 can be a thin metal sheet having a center portion 75 offset laterally by a bend 77 to give the panel rigidity, and leaving a flat edge strip 79. This flat edge strip 79 is widened at 81 to accommodate a latch opening 83. This opening 83 has opposed small lateral notches 85 adjacent one end 87 closest to the edge 89 of the door panel 73, and second longer opposed lateral notches 91 adjacent the second end 93 of the opening 83 forming tangs 99. Spaced inwardly from the second end 93 of the opening 83 is a small rectangular opening 95, the purpose of which will be explained below. A third opening or knockout 97 can be used to accommodate a lock (not shown).

The latch 1 is installed in the door panel 73 by aligning the bosses 29 and 31 with the notches 85 and 91 and then inserting the actuator 15 through the opening 83 until the rear face 17 of the base 7 contacts the door panel. The latch 1 is then slid toward the edge 89 of the door panel so that the grooves 33 are engaged by the tangs 99 and 101. The wedge shaped stop 37 drops into the rectangular opening 95. The spring member 5 is then compressed toward the actuator 15 so that the slot 71 in the hook 69 can engage the panel at the second end 93 at the opening 83. As the elongated elements 47, 49, 55, 57 are molded in a relaxed, elongated configuration, the bending of these elements at the integral hinges to insert the hook 69 in the second end 93 of the opening 83 generates a biasing force which urges the latch 1 toward the edge 89 of the door panel 73. When the door panel 73 is closed, the latch finger will engage a latch plate (not shown) to retain the door in the closed position. To unlatch the door, a finger is inserted in the finger pocket recess 43 to apply a force sliding the latch 1 away from the door edge 89 toward the second end 93 of the opening 83. An arrow 103 can be molded into the platform 41 to indicate the direction of movement for opening the latch 1. The wedge shaped stop 37 engages the end of the notch 95 to limit the travel of the latch 1 so that the bosses 29 and 31 cannot be aligned with the notches 85 and 91 and disengage the latch from the door panel. When the latch is released, the integral spring member 5 slides the latch 1 back toward the latched position. The end 87 of the opening 83 forms a stop which engages the actuator 15 to limit travel in the latching direction (See FIG. 3). The recess 35 in the rear face 17 of the base provides clearance for the hook 69 to engage the second end 93 of the latch opening 83 in the door panel, and to permit the base 7 of the latch member to slide relative to this hook member.

The latch 1 is integrally molded in one-piece from a suitable resin such as polypropylene.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended, and any and all equivalents thereof.

What is claimed is:

1. A door, comprising:

a one-piece polymeric door latch disposed in an opening having a first end and second end in said door, said door latch comprising:

a base member covering said opening from a front side of said door and reciprocally slidable toward said first and second ends of said opening;

an actuator integral with and extending generally transversely from said base member through said opening;

a latch finger integral with and projecting from said actuator toward said first end of said opening;

a spring member integral with and extending generally perpendicularly from said base member and engaging said door; said spring member biasing said latch member toward said first end of said opening to place said latch finger in a latched position and yielding to sliding of said latch member toward said second end of said opening; and said spring member having a first pair of spaced, parallel, elongated elements each having a first end integrally hinged to said latch member and a second end, a second pair of spaced, parallel elongated elements each having a first end integrally hinged to said second end of a separate one of said first pair of elongated elements and having second ends, a transverse beam integrally hinged to said second end of each of said elongated elements of said second pair of elongated elements and a hook member integral with said beam and having a slot which engages said door.

2. The door of claim 1 wherein said first ends of said first pair of elongated elements are integrally hinged to said actuator of said latch member and wherein said slot in said hook member is adapted to engage said door at said second end of said opening.

3. The door of claim 2 wherein said actuator has a finger recess accessible from a front face of said latch member.

4. A door, comprising;

a one-piece polymeric door latch disposed in an opening having a first end and second end in said door, said door latch comprising:

a base member covering said opening from a front side of said door and reciprocally slidable toward said first and second ends of said opening;

an actuator integral with and extending generally transversely from said base member through said opening;

a latch finger integral with and projecting from said actuator toward said first end of said opening;

a spring member integral with and extending generally perpendicularly from said base member and engaging said door, said spring member having a first end integral with said actuator and a second end terminating in a terminal member, said terminal member engaging said door; said spring member biasing said latch member toward said first end of said opening to place said latch finger in a latched position and yielding to sliding of said latch member toward said second end of said opening; and said spring member having a first elongated member integrally hinged at said first end to said actuator and having a second end, and a second elongated member integrally hinged at a first end to said second end of said first elongated member and integrally hinged at a second end to said terminal member, said first and second elongated members each comprising a pair of spaced, parallel elongated elements and wherein said terminal member comprises a transverse beam integrally hinged to and connecting second ends of said second elongated elements and a hook member integral with said beam having a slot engaging said second end of said opening in said door.

* * * * *